United States Patent [19]

Cleevely et al.

[11] Patent Number: 4,724,977

[45] Date of Patent: Feb. 16, 1988

[54] TAMPER-EVIDENT, RECLOSABLE, PLASTIC LID

[75] Inventors: Bruce T. Cleevely; Harry M. George, both of Pittsburgh, Pa.

[73] Assignee: Acorn Technology Inc., Pittsburgh, Pa.

[21] Appl. No.: 46,212

[22] Filed: May 5, 1987

[51] Int. Cl.[4] ..... B65D 51/22

[52] U.S. Cl. ..... 220/258; 220/276; 220/307; 220/339; 222/153

[58] Field of Search ..... 220/258, 266, 270, 307, 220/339, 276; 215/235, 237; 222/153

[56] References Cited

U.S. PATENT DOCUMENTS

| | | | |
|---|---|---|---|
| 3,282,477 | 11/1966 | Henohert | 220/258 |
| 3,434,620 | 3/1969 | Laurizio | 220/258 |
| 3,499,572 | 3/1970 | Reukberg . | |
| 4,059,201 | 11/1977 | Foster | 220/258 |
| 4,210,618 | 7/1980 | Piltz et al. | 220/270 |
| 4,212,409 | 7/1980 | Jeppsson | 220/276 |
| 4,267,937 | 5/1981 | Piltz et al. | 220/267 |
| 4,380,303 | 4/1983 | Allen et al. | 220/276 |
| 4,448,324 | 5/1984 | Jeppson et al. | 220/266 |
| 4,463,869 | 8/1984 | Lewis | 220/307 |
| 4,533,062 | 8/1985 | Krautkramer | 220/258 |

*Primary Examiner*—George T. Hall

*Attorney, Agent, or Firm*—Parmelee, Miller, Welsh & Kratz

[57] ABSTRACT

An integrally molded, generally rectangular, tamper-evident, reclosable lid for a container is formed from a rigid thermoplastic and has a peripheral wall section that defines a recess, with a rupturable planar member extending across the recess, and has an integral closure member hingedly connected to the peripheral wall section. The planar member and closure member provide a double seal prior to opening by a user, and after removal of the rupturable portion of the planar member, the integral hinged closure member provides a seal for the contents of the container. The lid is formed from a rigid plastic having a tensile modulus and flexural modulus in excess of $100\times10^3$ p.s.i. and a melting point in excess of 140° C. to provide a lid resistant to removal from a container as well as other properties desired.

12 Claims, 10 Drawing Figures

TAMPER-EVIDENT, RECLOSABLE, PLASTIC LID

CROSS-REFERENCE TO RELATED APPLICATIONS

The present application is related to the following three co-pending applications of the present inventors filed on even date herewith:

"Reclosable, Tamper-Evident Plastic Lid for a Container Having a Circular Wall";

"Plastic Container with Integral Tamper-Evident Reclosable Lid"; and

"Method of Molding Rigid Plastic Members Having a Tear Element."

The present invention relates to a generally rectangular lid for a container, the lid formed completely from a relatively rigid plastic material, such as polypropylene, and having a tear-away portion, with an integral closure member or cap that seals the container after the tear-away portion of the lid has been removed.

Numerous attempts have been made to provide lids for containers such as those which contain foodstuffs, coffee, nuts and the like, which are tamper-evident and which can be resealed once the container contents have been exposed. A prevalent such system, at present, comprises a container formed from a metal, such as aluminum, which has a tear-away metal lid and a separate supplemental plastic cover for resealing the container once the tear-away metal lid has been removed. A reason for using a metal lid in such a combination container closure is the property of the metal to resist oxygen permeability and moisture transfer from the atmosphere to the container contents. Such dual closure systems are however expensive. Also, a problem exists of the consumer cutting a hand on the sharp metal edges of the tear-away metal lid or the rim of the container upon removal of the lid.

While some lids have been suggested that are formed from solely a plastic material, such lids are usually formed from polyethylene which is easy to mold and which can be provided with a tear-away portion. A lid formed from polyethylene, however, does not provide the desired high resistance to moisture passage from the atmosphere to the contents of the can or from the contents of the can out of the container to the atmosphere. Such polyethylene materials similarly do not provide the desired resistance to oxygen permeability through the container. Also, since polyethylene is a relatively pliable material, a possibility exists for removal of the polyethylene lid and resecurement thereof on a container, which thus does not provide the requisite tamper-evident feature desired.

Polypropylene and other more rigid types of thermoplastic materials would be highly desirable in forming container closures but such materials are more difficult to mold and especially difficult to mold into a shape that would provide a weakened tear line.

In U.S. Pat. No. 3,499,572, an easy-opening lid structure has a tear portion and a remaining portion welded together along a rupturable weld line of fused material of both portions. A sequential molding process is described for use in forming the lid, where two confronting movable mold bodies are closely spaced to define two separated lid portions with a small gap therebetween and, after molding of the two separated lid portions, the confronting mold bodies are moved slightly apart due to pressure buildup, and the gap is filled with plastic to connect the two lid portions together by a tearable weld line. The plastic material is said to flash across the gap to form a fused or merged weld line.

In U.S. Pat. No. 4,448,324, a container closure is described which is formed by a sequential molding process and a weld zone is formed between two molded portions. The method involves sequentially molding two parts, with injection molding of the second part carried out so that the molecule chains of the plastic material essentially are broken in the weld zone and/or so that the temperature of the plastic material in the first and second parts is maintained at a lower level than required for complete fusing together. The sequential molding process is used to make container closures with a tear-out portion and preferably closures of a composite type where a thin metal foil and plastic material composite is used.

To our knowledge, no tamper evident polypropylene lid has been made commercially available wherein a lid has a tear-away portion to act as a tamper-evident feature and also has an integrally formed reclosable lid section.

It is an object of the present invention to provide an integral tamper-evident and reclosable lid for a container that has a tear-away portion and integral reclosable member, which is formed from polypropylene or other such rigid polymeric material.

SUMMARY OF THE INVENTION

An integrally molded, tamper-evident, reclosable generally rectangular plastic lid for a container has a peripheral wall section that defines a recess, with a rupturable planar member extending across the recess and an integral closure member hingedly connected to the peripheral wall section. The lid is formed from a rigid thermoplastic.

The integral closure member is hingedly secured to a first side of the peripheral wall section and is adapted to completely cover the recess and planar member, while locking means are provided to lock the closure member and seal the container when the planar member is intact, and also when the planar member is ruptured and removed so as to provide access to the contents of the container to which the lid is engaged.

The rectangular, peripheral wall section is preferably formed as an upper rim having a pair of downwardly extending spaced skirts depending therefrom to engage the upper edge of side walls of the container therebetween. An inwardly disposed raised platform is provided on the rim which has a downwardly extending inner wall defining the recess, with the closure member hingedly secured to a raised ledge on a first side of the peripheral wall section, with the closure member covering both the recess and platform when in closed position. A downwardly depending sealing flap is provided on the closure member that engages means on the downwardly extending inner wall of the raised platform to seal the lid.

The integral lid is formed from a rigid plastic material, such as polypropylene, that has a tensile modulus and also a flexural modulus in excess of $100\times10^3$ p.s.i. (pounds per square inch), and a melting point in excess of about 140° C., to provide the rigidity necessary to resist unauthorized removal and replacement of the lid on a container once the container has been filled.

DETAILED DESCRIPTION

Figure 1:
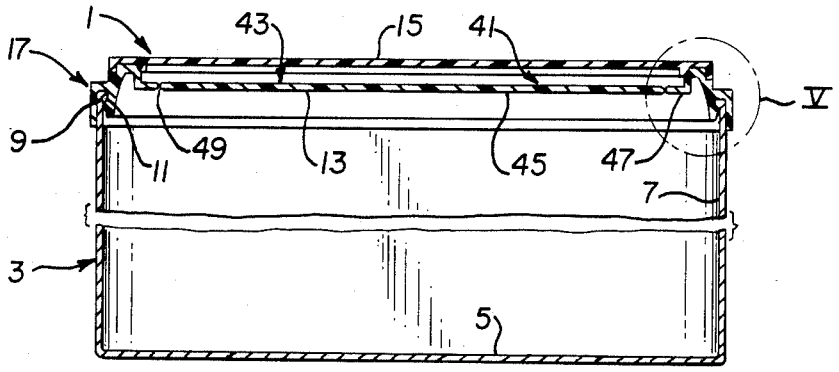
FIG. 1 is a vertical cross-sectional view of the rectangular, tamper-evident, reclosable, plastic lid of the present invention secured to a metal container of a rectangular shape.
Figure 2:
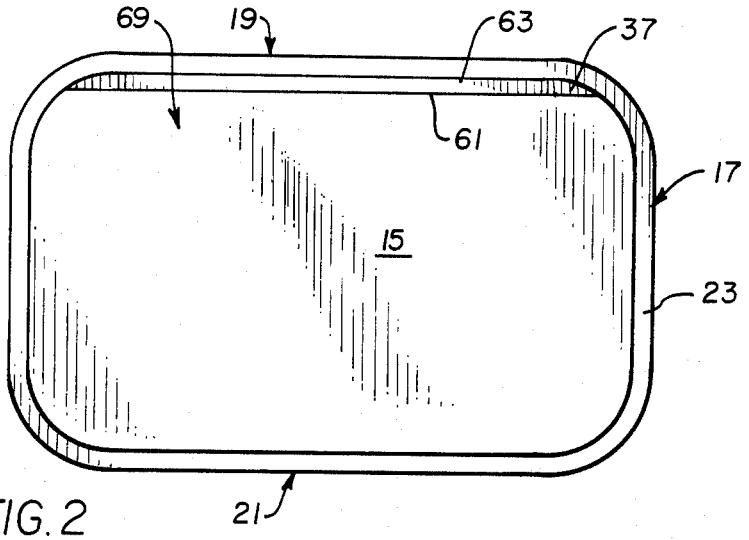
FIG. 2 is a top plan view of the plastic lid of the present invention with the closure member thereof in closed position.

Referring now to the drawings, an integrally molded rectangular, tamper-evident, reclosable plastic lid 1 for a container 3 is illustrated, wherein the container 3 is formed from a metallic composition. While the lid 1 is formed of a rigid plastic, the same may be used with containers formed from metallic, plastic or other compositions. The container 3 has a bottom 5 and upwardly extending sidewalls 7 which terminate in an upper edge 9, the upper edge having an engaging means such as an inwardly extending lip 11 thereabout for engagement of the container 3 with the lid 1 as hereinafter described. While the engaging means is illustrated as a lip 11, the same could also be a curled or inverted J-shape edge or other engaging means.

Figure 5:
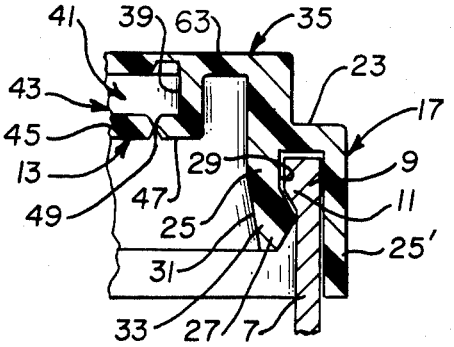
FIG. 5 is an enlarged view of the area of the plastic lid and container wall defined by the circle V of FIG. 1.

The lid 1 which is formed from polypropylene or other rigid polymer, provides a double seal when initially engaged on the container through use of a plastic planar member 13 and a hinged closure member 15. The lid 1 has a peripheral wall section 17 having opposed first side 19 and second side 21, and is engageable with the upper edge 9 of the side walls 7 of the container 3. Various engagement means may be provided, as for example, as illustrated, by forming a peripheral wall section 17 having an upper rim 23 and a pair of downwardly extending spaced inner and outer skirt 25, 25', respectively (FIG. 5) which depend from the rim 23. An outwardly directed flange 27 may be provided on the inner wall 29 of the inner skirt 25 facing spaced outer skirt 25', such that the inwardly directed lip 11 on the upper edge 9 of the wall section 7 of the container 3 is trapped between the spaced skirts 25, 25', upon forcing the lid onto the open upper edge 9 when initially securing the lid 1 to the container 3. As shown in FIG. 5, the inner skirt 25 may be formed with an inner chamfered portion 31 about the lower section 33 thereof, to permit inward bowing of the lower section thereof for placement of the lid 1 on the container 3.

Figure 3:
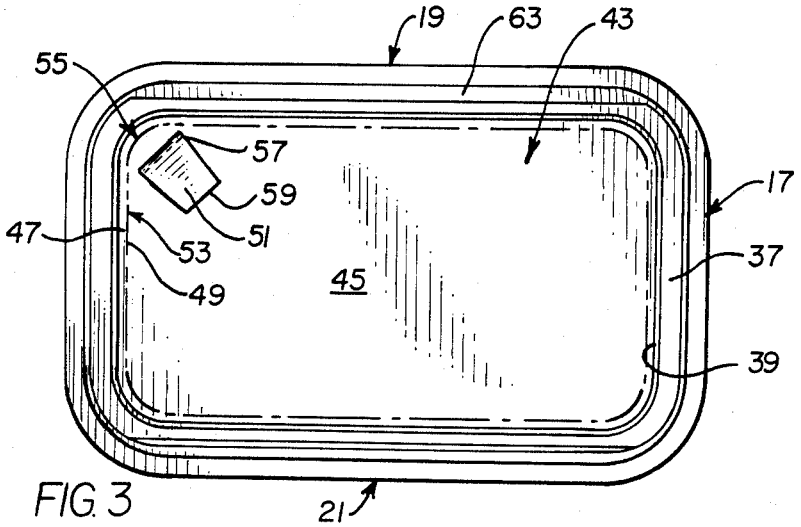
FIG. 3 is a top plan view of the plastic lid of the present invention with the closure member removed to show the planar member thereof.
Figure 4:
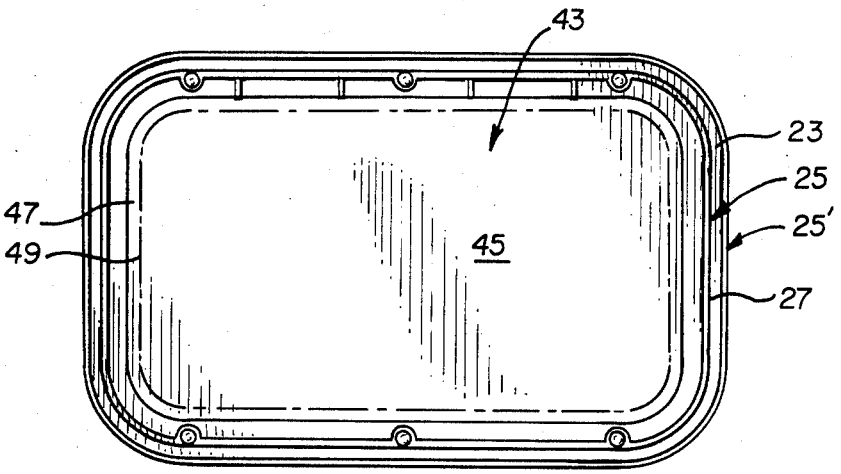
FIG. 4 is a bottom view of the plastic lid with the planar member thereof intact.

As illustrated, the peripheral wall section 17 has an inwardly disposed raised platform 35 thereon, the platform 35 having a raised surface 37 and downwardly extending inner wall 39 which defines a recess 41 enclosed by the peripheral wall section 17. The plastic planar member 13 extends across the recess 41 and provides a seal between the recess and the area therebelow. The planar member 13 has a rupturable portion 43 to allow access to the contents of the container 3 after securement of the lid 1 thereon. The rupturable portion 43 preferably comprises a central portion 45 of the planar member 13 that is bounded by an outer peripheral portion 47 and a tear line 49 formed intermediate the central portion 45 and outer peripheral portion 47. It should be noted, however, that the planar member may be formed as a rupturable portion wherein the tear line is formed between the planar member 13 and the peripheral wall section 17, whereby the entire planar member would be removable. The tear line is formed at a weld line between two supplies of plastic material. A pull tab 51 (FIG. 3) is integrally molded adjacent an edge 53 of the central portion 45 in close promixity to the tear line 49, preferably at a position adjacent a corner 55 thereof when the central portion 45 is of a rectangular or square configuration. The pull tab 51 is shown exposed, but if desired, the same could be disposed within an adjacent depression or well (not shown) in the central portion 45 of the planar member 13. The pull tab is integrally molded to the central portion 45 at one end 57 thereof and has an opposed end 59 that is raised from the central portion 45 to permit grasping thereof by a user.

Figure 6:
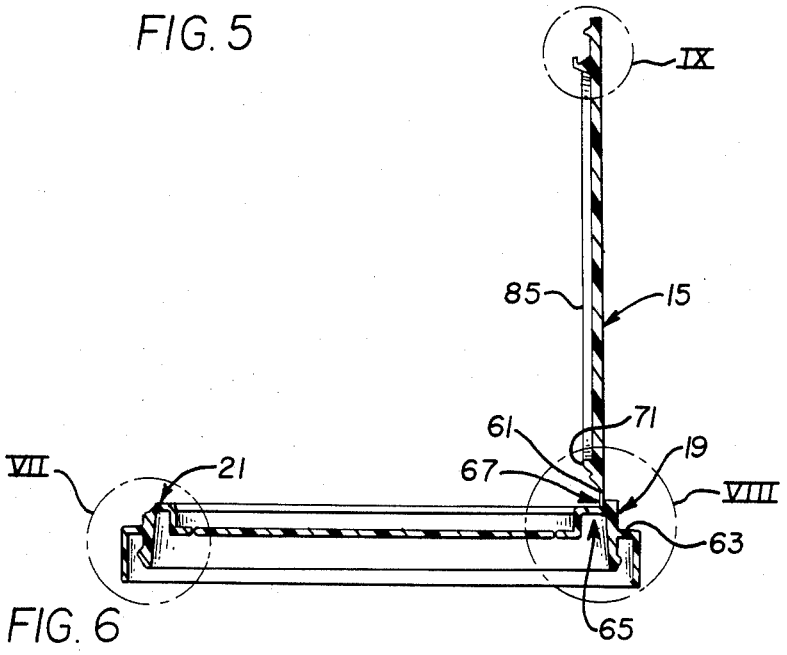
FIG. 6 is a vertical cross-sectional view of the plastic lid shown in FIG. 1, transverse the view shown therein, showing the closure member in raised position.
Figure 7:
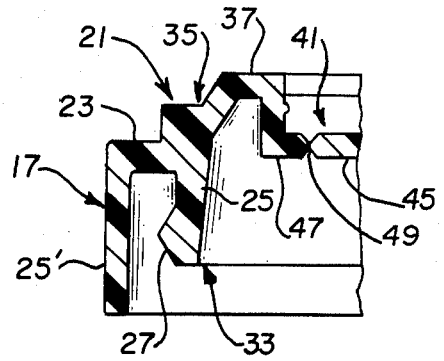
FIG. 7 is an enlarged view of the plastic lid defined by the circle VII of FIG. 6.
Figure 8:
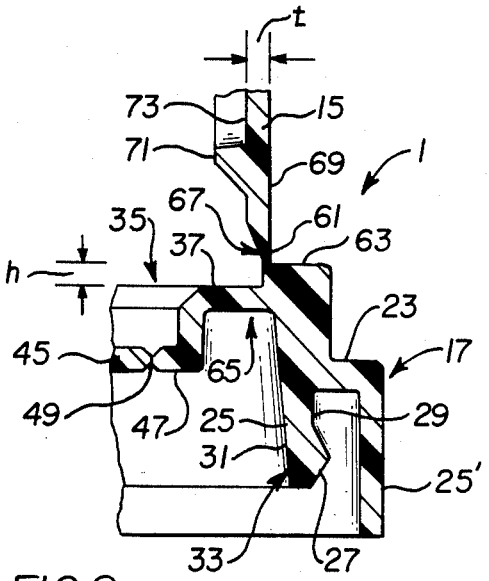
FIG. 8 is an enlarged view of the plastic lid defined by the circle VIII of FIG. 6.
Figure 9:
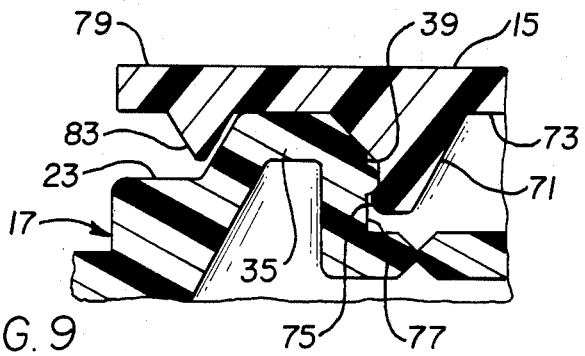
FIG. 9 is perspective top view of the plastic lid defined by the circle IX of FIG. 6, with the closure member in closed position.

The lid 1 also has integrally molded therewith the closure member 15 that is sized to completely cover the recess 41 and preferably platform 35, and is hingedly interconnected to the first side 19 of the peripheral wall section 17 by a plastic hinge 61. As shown in FIGS. 6 and 8, a raised ledge 63 is provided on a first side 19 of the peripheral wall section 17 of lid 1, at the outer region 65 of platform 35 and the hinge 61 integrally molded to the inner region 67 of the ledge. The closure member 15 is of a thickness t substantially equal to the height h of the ledge 63 above the platform 35, such that the upper surface 69 of the closure member 15 lies relatively flush with the top of ledge 63 when the closure member 15 is in closed position. As a sealing means for the lid, a downwardly depending sealing flap 71 is provided on the lower surface 73 of the closure member at a spaced location from the peripheral edge thereof, which sealing flap extends into the recess 41 when the closure member is closed. As an engagement means, the flap has an outwardly extending bead 75 which cooperates with a groove 77 about the downwardly extending rim wall 39 of the peripheral wall section 17 of the lid. The closure member 15 is sized to completely cover the recess 41 and has bead 75 on flap 71 and groove 77 on the inner wall 39 of platform 35 to act as a locking means to secure the closure member to the opposed second slde wall section 21 of the lid. Preferably, an outwardly extending ledge 79 is provided on the edge of the closure member 15 opposite hinge 61 which provided access for a user's finger to raise the closure member from closed locked position.

To provide supplemental sealing and locking, the closure member 15 has a downwardly extending peripheral rim 83 spaced from the sealing flap 71, such that the platform 35 is disposed between the rim and flap when the closure member is in closed position. Side beads 85 may also be provided on the flap 71 to assure a secure sealing of the closure member in closed position, the beads 85 bowed outwardly to engage inwardly directed lips 87 on the peripheral wall section 17.

Figure 10:
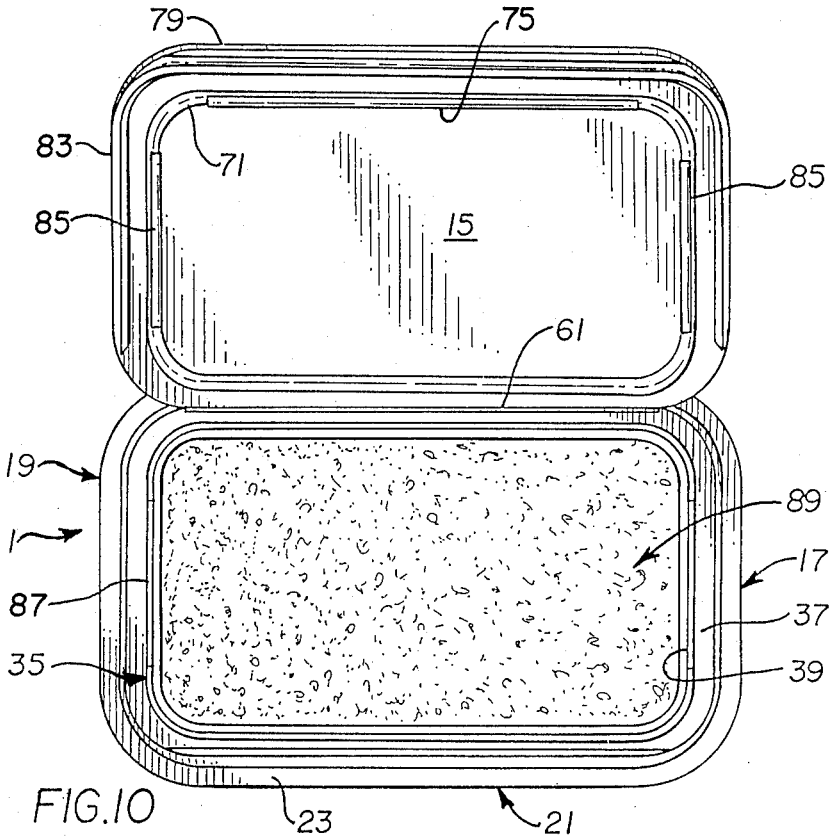
FIG. 10 is a perspective top view of the plastic lid of the present invention on a filled container with the closure member in raised position, and the planar member ruptured and removed, with the contents of the container exposed for access by a user.

The perspective view of the plastic lid in FIG. 10 illustrates the closure member 15 in raised position along hinge 61, after the rupturable portion 43 of the planar member 13 has been removed to provide access to the contents 89 of the container. The user, after lifting the closure member 15, grasps the opposed or free end 59 of the pull tab 51 and tears the central portion 45 of the planar member 13 free from the outer peripheral portion 47 along the tear line 49, which central portion may then be discarded. The removal of the central portion 45 leaves the contents 89 of the container exposed to the atmosphere with access to the contents available to the user. After use, the closure member 15 is then moved to closed position to protect the contents 89 of the container from the atmosphere and seals the same from moisture or other undesirable constituents of the atmosphere that would deleteriously affect the contents of the container.

As an example of the dimensions of such a lid, a tamper-evident, reclosable, plastic lid was formed from polypropylene using a polypropylene homopolymer sold under the name of Shell 5820, a crystalline-type rigid thermoplastic. The thickness of the central and peripheral portions 45 and 47 of the planar member 13 was about 0.035 to 0.040 inch, preferably 0.035 inch. The tear line 49 was formed by a welding of two supplies of molten polypropylene and was found to have a critical range of dimensions, with the thickness of the tear line being between 0.002 to 0.007 inch, while the width of the tear line would vary from 0.001 to 0.025 inch. A thickness of less than about 0.002 inch is unusable because the flow of polypropylene into the tear line area of a mold cavity cannot be effected, while a thickness greater than about 0.007 provides a tear line that is too difficult to tear and/or leaves undesirable jagged edges along the tear line. A correlation exists between the thickness and width of the tear line in that the larger the thickness of the tear line in the range that is used, the larger the width of the tear line, within the respective range, that is required, i.e., a tear line of about 0.007 inch thick would require a width of about 0.025 inch, while a thickness of about 0.002 inch requires a width at the lower range thereof, or about 0.001 inch. In the above-dimensioned lid, the tear line had a thickness of about 0.003 to 0.005 inch and a width of about 0.012 inch. In that lid also, the thickness t of the closure member 15 was about 0.040 inch, with the hinge 61 having a thickness of about 0.008 to 0.012 inch, preferably 0.010 inch. The hinge 61 cannot be less than about 0.008 inch in thickness since flow across the section of the mold cavity to form the hinge and subsequently the closure member is very difficult, while a hinge thickness of greater than about 0.012 inch would not provide the requisite pliability and hinge action needed. It should be noted that the thickness of the hinge is always greater than the thickness of the tear or weld line of the lid.

While the integral, tamper-evident, reclosable plastic lid of the present invention is preferably made from a polypropylene homopolymer, copolymers thereof having up to about 6 percent of a comonomer such as ethylene, and preferably less than about 3 percent of such a comonomer, or ethylene and a termonomer such as butene -1, pentene -1 or hexene -1, the total thereof being less than about 6 and preferably less than 3 percent may be used. Also, other thermoplastics having the desired properties may be used, such as a nylon polymer such as nylon 6 or nylon 6/6, a polymethyl pentene polymer, or a polycarbonate.

The plastic that is used in the present invention is one having sufficient oxygen and moisture barrier properties, as well as environmental stress crack resistance. The plastic should have sufficient stiffness yet possess properties for formation of a hinge integral between the closure member and wall sections. The tensile modulus of such a plastic material should be in excess of about $100\times10^3$ p.s.i. according to ASTM D638, and a flexural modulus in excess of about $100\times10^3$ p.s.i. according to ASTM D790, while the melting point or glass transition temperature should be in excess of about 140° C.

By use of a plastic having a tensile modulus and flexural modulus in excess of about $100\times10^3$ p.s.i., a rigid lid is provided that resists flexing of the walls of the lid sufficient to remove the lid from the container and possibly replace the same without indication to a prospective purchaser or user of the container having the lid. A glass transition temperature or melting point of about 140° C. or more of the plastic used also inhibits heating of the lid for softening and possible removal and replacement.

In addition, the plastic must have environmental stress crack resistance to prevent damage to the lid by oils or vapors from the contents of the container, as well as oxygen and moisture impermeability, sufficient to provide a desired shelf life for the contents of a container upon which the lid is used.

What is claimed is:

1. An integrally molded, generally rectangular, tamper-evident, reclosable plastic lid for a container, the container having a bottom and upwardly extending side walls terminating in an upper edge, said lid comprising:

a peripheral wall section, having opposed first and second sides, engageable with the upper edge of said container, said peripheral wall section defining an enclosed recess;

a plastic planar member extending across said recess;

a rupturable portion on said planar member allowing access to the contents of the container when the lid is engaged therewith and said rupturable portion removed;

an integral closure member hingedly secured to the first side of said peripheral wall section adapted to completely cover said recess and said planar member therein; and locking means securing said closure member to the opposed second side of said peripheral wall section to lock said closure member and seal said container when said planar member is intact and also after removal of said rupturable portion of the planar member;

said plastic lid formed from a plastic material having a tensile modulus in excess of about $100\times10^3$ p.s.i., a flexural modulus in excess of about $100\times10^3$ p.s.i., and a melting point in excess of 140° C.

2. An integrally molded, generally rectangular, tamper-evident, reclosable plastic lid for a container as defined in claim 1 wherein the rupturable portion on said planar member comprises a central portion bounded by an outer peripheral portion, and a tear line is formed as a weld line intermediate said central and peripheral portions.

3. An integrally molded, generally rectangular, tamper-evident, reclosable plastic lid as defined in claim 1 wherein said plastic lid is formed completely of polypropylene.

4. An integrally molded, generally rectangular, tamper-evident, reclosable plastic lid as defined in claim 1 wherein said peripheral wall section is formed as an upper rim and a pair of downwardly extending spaced skirts depending from said rim, the upper edge of the side walls of the container engageable between said pair of skirts.

5. An integrally molded, generally rectangular, tamper-evident, reclosable plastic lid as defined in claim 1 wherein said rupturable portion of said planar member has a pull tab integrally molded with the upper surface thereof.

6. An integrally molded, generally rectangular, tamper-evident, reclosable plastic lid as defined in claim 1 wherein said peripheral wall section has an inwardly disposed raised platform thereon, said platform having a downwardly extending inner wall which defines said recess, and said closure member covers both said recess and said raised platform.

7. An integrally molded, generally rectangular, tamper-evident, reclosable plastic lid as defined in claim 6 wherein a raised ledge is provided on said first side of the peripheral wall section, said closure member is hingedly secured to said ledge, and a downwardly depending sealing flap is provided on the lower surface of the closure member, and engagement means are provided on said sealing flap and said downwardly extending inner wall of said raised platform to seal the lid when said engagement means is secured.

8. An integrally molded, generally rectangular, tamper-evident, reclosable plastic lid as defined in claim 7 wherein a downwardly extending peripheral rim is provided on said closure member spaced from said sealing flap, whereby said platform is disposed between said rim and sealing flap when the closure member is in closed position.

9. An integrally molded, generally rectangular, tamper-evident, reclosable plastic lid as defined in claim 2 wherein said plastic lid is formed completely from polypropylene, said central and peripheral portions of said planar member have a thickness of between about 0.035 to 0.040 inch and said tear line has a thickness of 0.002 to 0.007 inch and a width of about 0.001 to 0.025 inch.

10. An integrally molded, generally rectangular, tamper-evident, reclosable plastic lid as defined in claim 9 wherein said tear line has a thickness of about 0.003 inch and a width of about 0.012 inch.

11. An integrally molded, generally rectangular, tamper-evident, reclosable plastic lid for a container, the container having a bottom and upwardly extending side walls terminating in an upper edge, said lid comprising:

a peripheral wall section, having first and second sides, formed as an upper rim and a pair of downwardly extending spaced skirts depending from said rim, the upper edge of the side walls of the container engageable between said pair of skirts, said peripheral wall section defining an enclosed recess;

a plastic planar member extending across said recess;

a rupturable portion on said planar member comprising a central portion, having a pull tab integrally molded with the upper surface thereof, bounded by an outer peripheral portion, and a tear line formed as a weld line intermediate said central and peripheral portions, allowing access to the contents of the container when the lid is engaged therewith and said central portion removed;

an integral closure member hingedly secured to the first side of said peripheral wall section adapted to completely cover said recess and said planar member therein; and locking means securing said closure member to the opposed second side of said peripheral wall section to lock said closure member and seal said container when said planar member is intact and also after removal of said rupturable portion of the planar member;

said plastic lid formed from a plastic material having a tensile modulus in excess of about $100\times10^3$ p.s.i., a flexural modulus in excess of about $100\times10^3$ p.s.i., and a melting point in excess of 140° C.

12. An integrally molded, generally rectangular, tamper-evident, reclosable plastic lid as defined in claim 11 wherein said plastic lid is formed completely of polypropylene.

* * * * *